US005124728A

United States Patent [19]

Denda

[11] Patent Number: 5,124,728

[45] Date of Patent: Jun. 23, 1992

[54] INK JET RECORDING APPARATUS WITH VACUUM PLATEN

[75] Inventor: Masaki Denda, Tokyo, Japan

[73] Assignee: Seiko Instruments, Inc., Tokyo, Japan

[21] Appl. No.: 554,341

[22] Filed: Jul. 19, 1990

[30] Foreign Application Priority Data

Jul. 19, 1989 [JP] Japan ..... 1-84692[U]

[51] Int. Cl.[5] ..... B41J 2/04; B41J 11/02

[52] U.S. Cl. ..... 346/134; 346/140 R; 400/648

[58] Field of Search ..... 346/134, 136, 140; 355/76, 312; 400/648, 662, 605

[56] References Cited

U.S. PATENT DOCUMENTS

| | | | |
|---|---|---|---|
| 3,741,116 | 6/1973 | Green et al. | 101/287 |
| 4,294,540 | 10/1981 | Thettu | 355/76 |
| 4,463,361 | 7/1984 | Koumura | 346/134 |
| 4,504,843 | 3/1985 | Prohl et al. | 346/138 |
| 4,992,805 | 2/1991 | Yoshizawa | 346/134 |

FOREIGN PATENT DOCUMENTS

| | | |
|---|---|---|
| 0038522 | 10/1981 | European Pat. Off. . |
| 3225593 | 3/1983 | Fed. Rep. of Germany . |

*Primary Examiner*—Joseph W. Hartary
*Attorney, Agent, or Firm*—Spenseley Horn Jubas & Lubitz

[57] ABSTRACT

An ink jet recording apparatus composed of a print head of the on-demand type for ejecting an ink droplet according to print data and a platen having a flat section opposed to the head and extending at least over a region corresponding to a printing span through which the head is displaced to effect printing. The flat section of the platen is formed with a plurality of opening holes each having a relatively small diameter. A vacuum device creates a vacuum beneath the platen to attract a recording medium onto the flat section to enable the recording medium to receive ink droplets ejected from the head so as to print an image. The dimensions or the density of the opening holes is gradually reduced so as to compensate for differences in width of the recording media to thereby effectively avoid floating of a medium.

5 Claims, 4 Drawing Sheets

FIG. 3
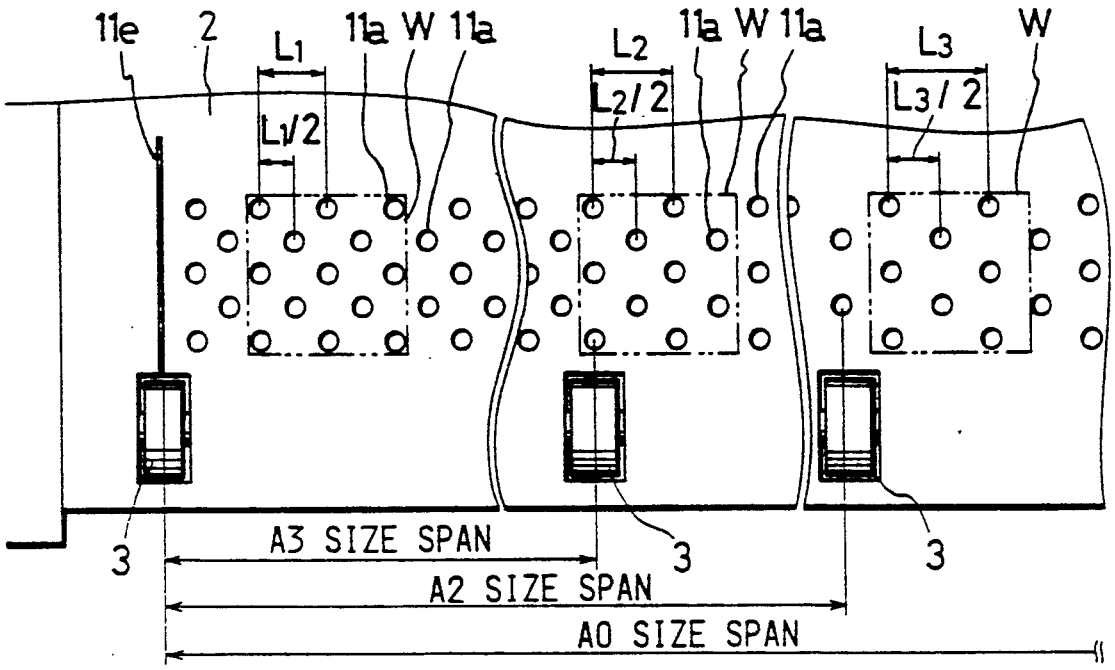
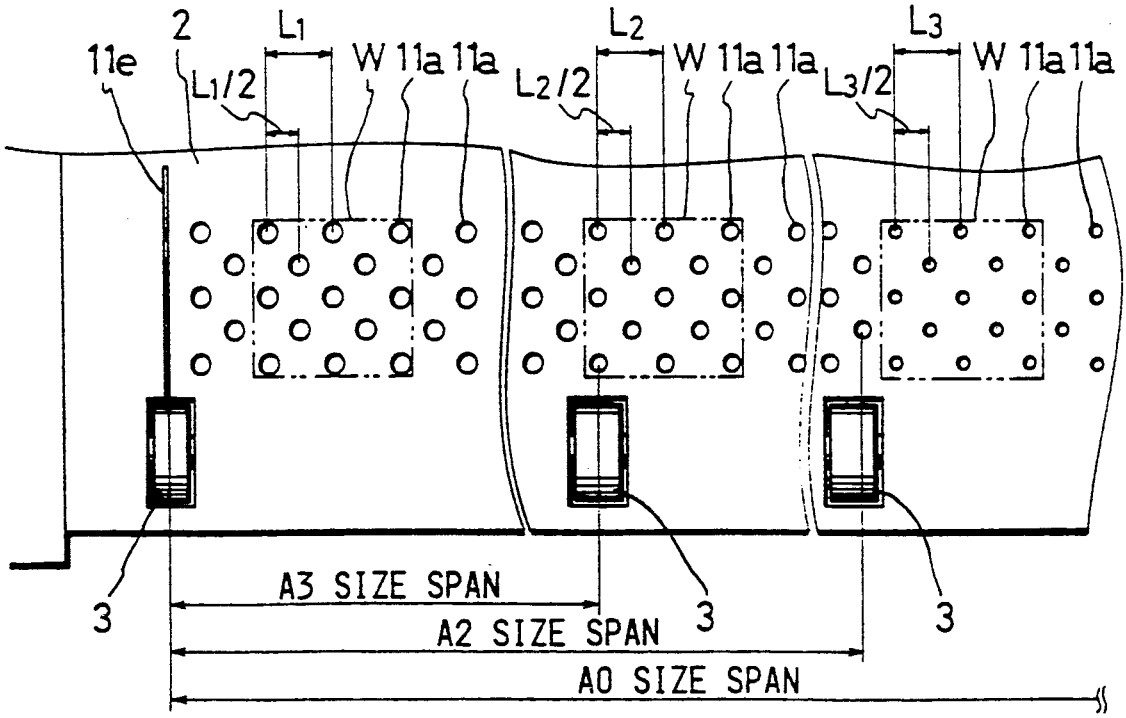
FIG. 4

FIG. 5 PRIOR ART
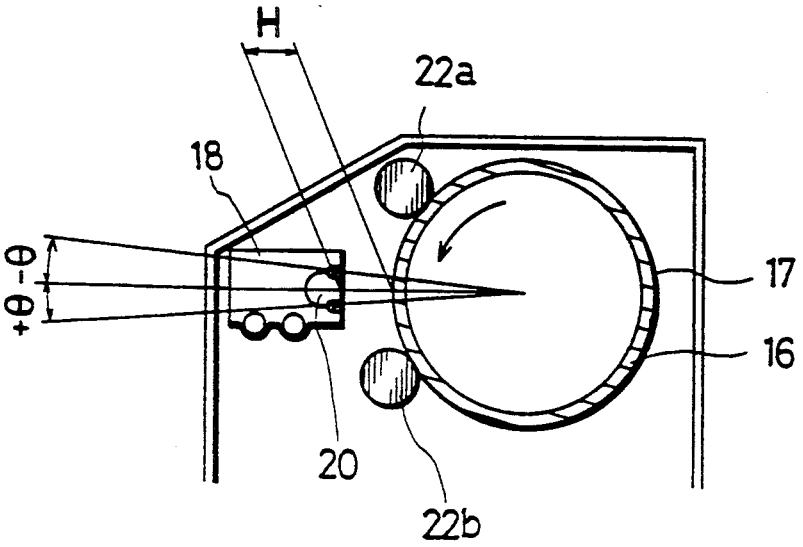
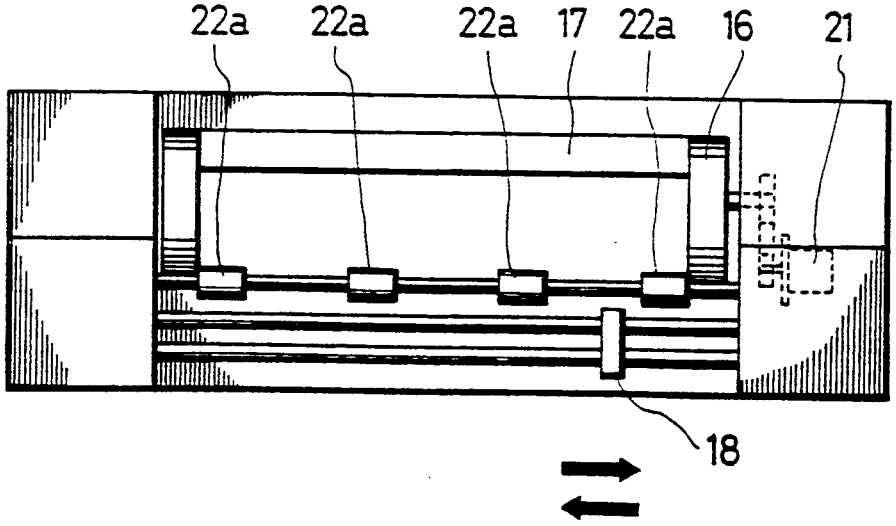
FIG. 6 PRIOR ART

INK JET RECORDING APPARATUS WITH VACUUM PLATEN

BACKGROUND OF THE INVENTION

Field of the Invention

The present invention relates to an ink jet recording apparatus, and particularly relates to means for maintaining a constant distance between a head and a recording medium.

As shown in FIGS. 5 and 6, conventionally a recording medium 17, such as a recording paper sheet or film, is wound around a platen 16 and is tensioned by a pair of pinch rollers 22*a* and 22*b* so that the recording medium 17 closely contacts the platen 16 to carry out printing.

However, in the conventional printing structure, a distance H between a nozzle tip 20 of a head 18 which ejects ink droplets and the recording medium 17 varies in the angular range of $\pm\Theta$ around the center line of platen 16. Further, in the multi-nozzle structure, the value of $\Theta$ is relatively great, so that H varies by a large amount, which causes degradation of print quality.

In ink jet recording, it is necessary to equalize as much as possible the distances from respective ones of an array of nozzle tips along the recording medium feeding direction (sub-scanning direction) to the face of the recording medium, and to minimize variations of traveling time of ink droplets in order to improve printing quality. When utilizing a head of the on-demand type, in order to compensate for the drawback of relatively low frequency of ink droplet production, multi-nozzle arrangements have been adopted. However, as noted above, it would be quite difficult to prevent degradation of printing quality without enlarging the platen diameter.

SUMMARY OF THE INVENTION

In order to solve the above noted problems of the prior art, an object of the present invention is to provide a recording apparatus composed of a platen having a flat section which extends correspondingly along a printing width through which a head is operated to effect printing, and vacuum means for attracting the recording medium. After placing the recording medium between the head and the platen, the vacuum means is operated to attract the recording medium onto the flat section of the platen so as to establish a constant distance between the head and the recording medium, thereby achieving high accuracy of ink droplet targeting to improve the print quality.

To achieve the above noted object, the inventive apparatus is provided with a platen having a flat section in opposed relation to the head and in registration with a printing region through which the head is driven to effect printing, and a plurality of opening holes having a relatively small diameter are formed to attract the recording medium onto the platen flat face by vacuum means so as to control and maintain the positioning of the recording medium to thereby avoid floating of the recording medium.

A recording medium such as paper or film is inserted into the above constructed ink jet recording apparatus to carry out a printing operation. The recording medium is gradually attracted onto the flat section of the platen within a region corresponding to printing width or span of the head by means of attractive forces generated in the small diameter opening holes in the platen face due to flow of air caused by the vacuum means. During the course of attraction of the recording medium, the small diameter opening holes are almost all closed so as to reduce the air flow quantity inside of the platen through the small diameter opening holes.

Consequently, air pressure is abruptly reduced between the recording medium and the platen to thereby boost the attractive force. With increase of the attractive force, the recording medium is completely attracted on the platen face so that the recording medium has a flatness identical to that of the platen flat section to avoid floating of the recording medium.

Further, depending on size of the recording medium in the widthwise direction (main scanning direction), many of the opening holes may be offset from the span of the recording medium to cause reduction of the attractive force. For example, when loading recording medium of A4 size into a printing apparatus which can print at most A0 size recording medium, $\frac{3}{4}$ of the opening holes will not be covered by the medium. In order to avoid such a force reduction, the dimensions or density of the opening holes is gradually reduced from the location of a guide for positioning the recording medium in the width direction so as to compensate for differences in width of recording media to thereby effectively avoid floating of a medium.

BRIEF DESCRIPTION OF THE DRAWINGS

FIG. 3 is a plan view of a first embodiment of a platen according to the invention.

FIG. 4 is a plan view of another embodiment of a platen according to the invention.

FIG. 5 is a sectional view of a conventional printing structure.

FIG. 6 is a plan view of the conventional printing structure shown in FIG. 5.

DESCRIPTION OF THE PREFERRED EMBODIMENTS

Figure 1:
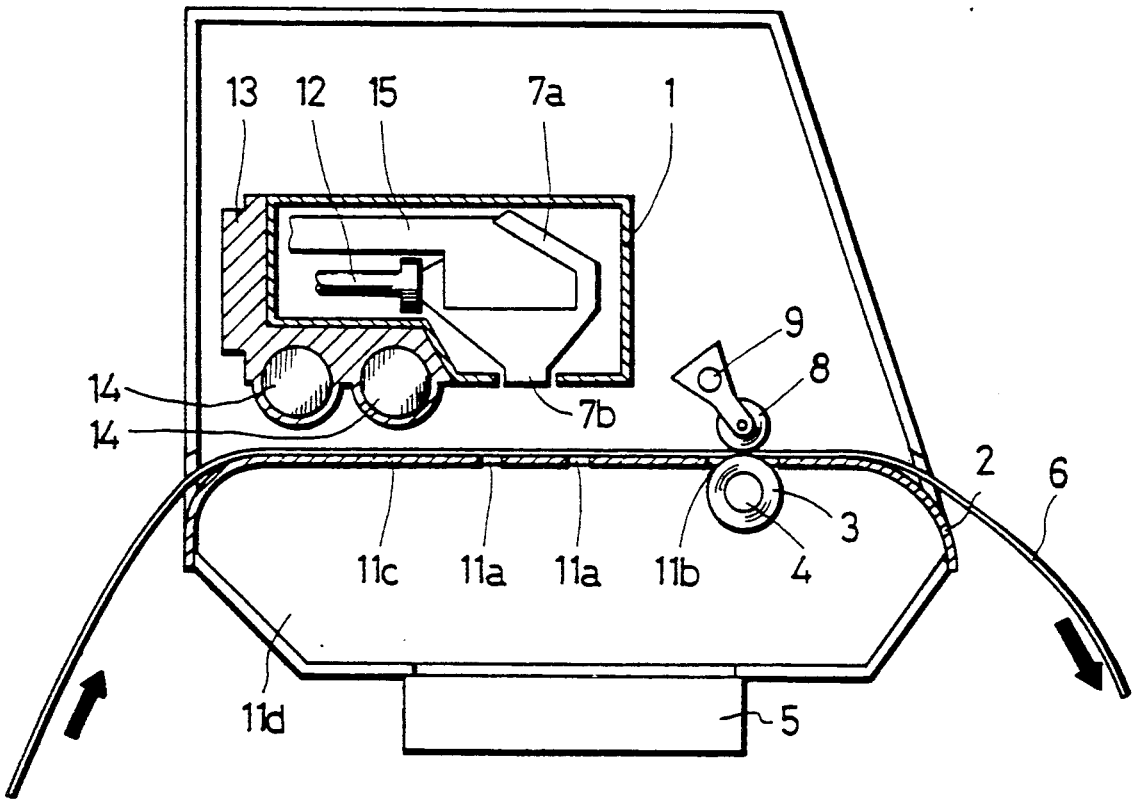
FIG. 1 is a cross-sectional view showing one embodiment of a printing mechanism according to the present invention.
Figure 2:
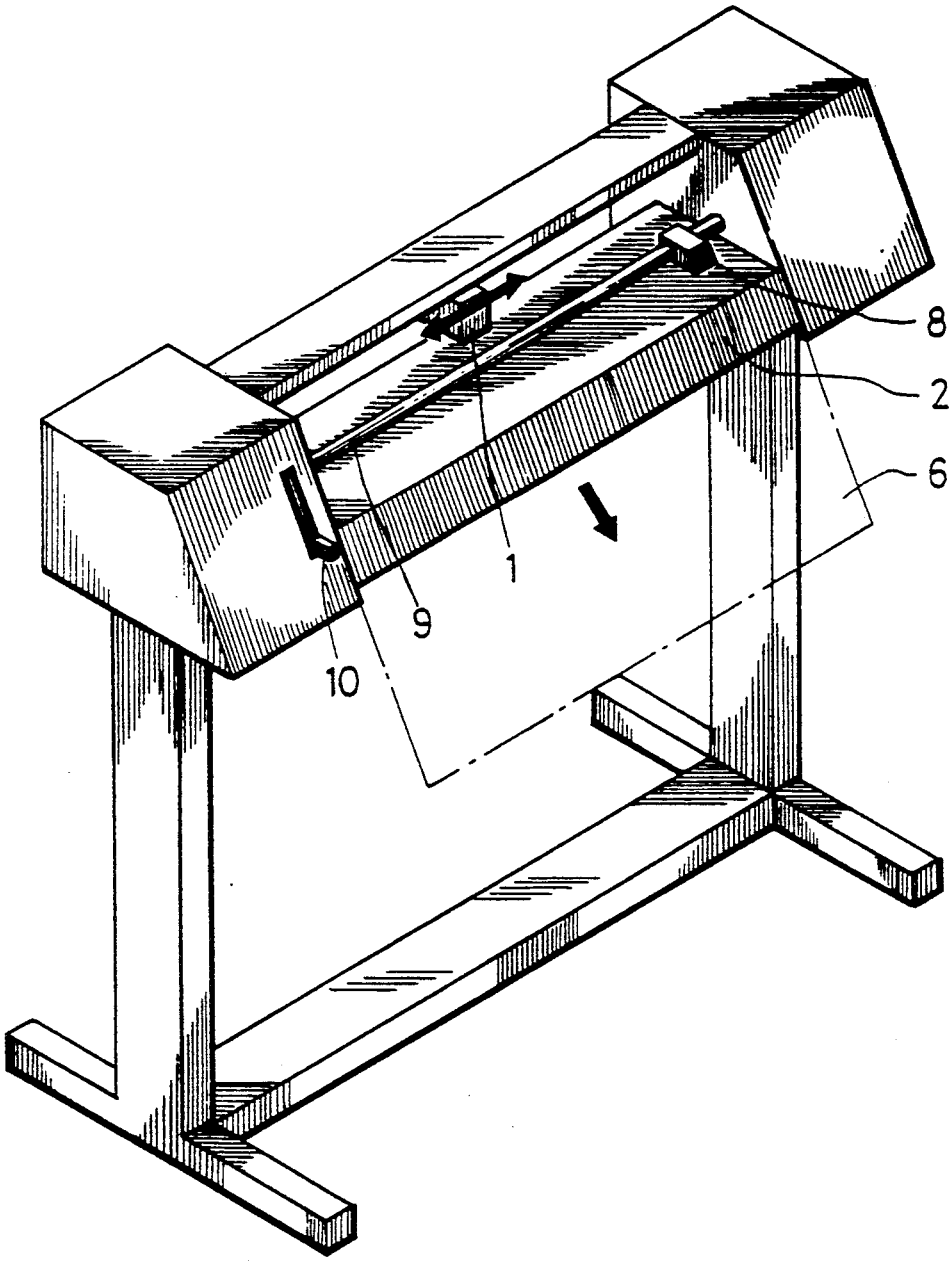
FIG. 2 is a perspective view of printing apparatus according to the invention containing the mechanism of FIG. 1.

Hereinafter, embodiments of this invention will be described with reference to the drawings. FIG. 1 is a sectional view of a printing mechanism according to the invention and FIG. 2 is a perspective view of the inventive printing apparatus. In these Figures, a platen 2 has a plurality of opening holes 11*a* having relatively small diameters, a plurality of large openings 11*b* for driving rollers 3 which feed a recording medium 6, and a flat section 11*c* extending on a front face of platen 2 over a region corresponding to a printing span of a head 1. A vacuum space 11*d* is provided below platen 2.

The vacuum space 11*d* communicates with the flat section 11*c* on the front face of the platen 2 through the plural opening holes 11*a* effective to attract recording medium 6. The width of vacuum space 11*d* and the width of the region occupied by opening holes 11*a* are set identical to the maximum width size of a recording medium which can be printed by the printing apparatus. In this embodiment, the width is set at about 841 mm for A0 size paper.

As shown in FIG. 3 or 4, the opening holes 11*a* are arranged such that total opening area A of the opening holes 11*a* per unit surface area W is gradually reduced with increasing distance from a guide 11*e* which determines the widthwise position of recording medium 6.

In the FIG. 3 embodiment, the opening holes 11*a* have a diameter of 3 mm and are arranged at a pitch $L_1=20$ mm within a span corresponding to an A3 size recording medium. Then, the opening holes 11*a* are arranged at a pitch $L_2=30$ mm beyond the A3 size span and within the size A2 span. Further, the opening holes 11*a* are arranged at a pitch $L_3=40$ mm beyond the A2 size span and within A0 size span.

In the FIG. 4 embodiment, all of the opening holes 11*a* are arranged at a pitch of $L_1=L_2=L_3=20$ mm, but the diameter of opening holes 11*a* is gradually changed in correspondence to the widthwise span of different recording medium sizes. In detail, the diameter of holes 11*a* is set at 3 mm within a span of A3 size recording medium, then is set at 2.35 mm beyond the A3 span and within the A2 span, and further is set at 1.86 mm beyond the A2 span and within the A0 span.

On the other hand, the opening holes 11*a* are arranged in the recording medium feeding direction (sub-scanning direction) such as to sufficiently cover a range opposed to multi-nozzle arrangement face 7*b* of the head 1. According to one embodiment, the total length of the multi-nozzle arrangement is set to 8 mm since 64 nozzles are arranged vertically at a pitch of ⅛ mm. Namely, the opening holes are arranged in the sub-scanning direction at a common pitch of 20 mm and extend in that direction over two pitch intervals so as to cover a range from minimum 20 mm to maximum 40 mm, as shown in FIGS. 3 and 4.

The vacuum means may include a fan 5 which sucks air from the vacuum space 11*d* inside the platen 2.

Reverting to FIGS. 1 and 2, each driving roller 3 sandwiches the recording medium 6 with a pinch roller 8 to feed medium 6 in the sub-scanning direction. A carriage 13 carries the head 1, and is supported by guide shafts 14 and is driven in a direction (main scanning direction) transverse to the feeding direction by means of a head-feeding servo motor, etc. (not shown) through a wire or belt and a spool (not shown) so as to undergo reciprocating movement.

In the present embodiment, the recording medium 6 is fed from a rear part to a front part of the printing apparatus by means of the driving rollers 3 and pinch rollers 8. The driving rollers 3 receive a drive force from a pulse motor (not shown) through a timing belt and a spool. An ink supply tube 12 supplies ink to the head 1 from an ink cartridge (not shown). A flexible circuit substrate 15 applies to each nozzle of the head 1 of a driving pulse based on printing data. As described before, the head 1 is a multi-nozzle ink jet recording head of the on-demand type. Sixty-four nozzles are linearly arranged in the sub-scanning direction at a pitch of 8 nozzles/mm and operate to eject ink droplets toward recording medium 6 on a demand basis in response to drive pulses fed from the flexible circuit substrate 15 according to printing data.

The next description is given for scanning operation of the above constructed embodiment of the inventive printing apparatus.

The recording medium 6 is set in an initial position such that a top edge thereof is sandwiched between the driving rollers 3 and the pinch rollers 8 in the sub-scanning direction, and a rear part thereof passes between head 1 and flat section 11*c* of platen 2, which defines a guide face of the recording medium 6, and rearwardly of the apparatus in a free or unconfined, state.

Then, the fan 5 is operated to initiate suction in space 11*d*. By this suction, air is evacuated from the vacuum space 11*d* beneath platen 2 and is expelled from space 11*d* through fan 5. Consequently, the pressure in space 11*d* is reduced such that air flows from above platen 2 along the recording medium 6 into the space 11*d* through the opening holes 11*a* so as to generate attractive forces.

Due to these attractive forces generated in the opening holes 11*a*, the recording medium 6 starts to closely contact the flat section 11*c* of platen 2. By this contact, many of the opening holes 11*a* are closed to reduce the quantity of air flowing through opening holes 11*a* to space 11*d* beneath platen 2. Consequently, air pressure is abruptly reduced in a gap between the recording medium 6 and the platen 2 to thereby boost the attractive forces. With increase of the attractive forces, the recording medium 6 is made to closely contact the flat section 11*c* of platen 2 such that the flatness of medium 6 becomes identical to that of the flat section 11*c* to prevent floating of recording medium 6.

The flat section 11*c* of the platen 2 is precisely finished to achieve flatness at an accuracy of less than 0.2 mm over an entire area within the printing span of head 1, and moreover platen 2 has a sufficient stiffness to avoid deformation such as bending due to the suction. Generally in ink jet printing, it is necessary to maintain the distance between the head 1 and the platen 2 in the order of 1.0 mm–1.2 mm. According to the present invention, recording medium 6 can be stably placed with a variation comparable to the variation of the flatness of platen 2.

The next description is given for operation after completion of the attraction of recording medium 6.

While displacing carriage 13 in the main scanning direction in response to a printing start signal, the recording head 1 mounted on carriage 13 is operated to eject ink droplets to effect printing according to print data. The printed pattern and ink jet amount can be determined according to the print data fed through the flexible circuit substrate or cable.

The printing interval in the sub-scanning direction is determined by the total number of nozzles and the pitch thereof arranged on the head 1. In this embodiment, the printing interval is set to 8 mm as described before. Accordingly with each line scanning of the carriage 13 in the main scanning direction, the recording medium 6 is intermittently fed forwardly of the printing apparatus by an 8 mm step through the driving rollers 3 and the pinch rollers 8. At this time, attractive forces at the opening holes 11*a* applied to the recording medium 6 can produce appropriate tension, or resistance to the feeding of the recording medium so as to facilitate stable feeding. During the course of the printing operation in the manner as described above, the recording medium 6 can be continuously attracted through the edge thereof to avoid any drawback such as floating.

The next description is given for printing recording media of different widths in the inventive printing apparatus.

The attractive forces on the recording medium can be boosted by closing the opening holes 11*a* with the recording medium 6 so as to efficiently avoid floating. Therefore, when inserting a recording medium 6 having a relatively small width, such as A4 size and A3 size, into the printing apparatus which has a relatively large maximum printing span covering, for example, A0 size of 841 mm in this embodiment, a ½ to ¾ of the opening holes 11*a* are not covered by the recording medium, thereby failing to generate strong attractive forces. In the present invention, in order to compensate for the resulting potential drawback, the opening holes are arranged such that the total opening area thereof per unit surface area of platen 2 is gradually decreased in the widthwise direction of the recording medium, from edge guide 11*e*, so as to avoid a considerable reduction of the attractive forces even when some of the opening holes are not covered by narrow recording medium 6.

In detail, the pitch of opening holes 11*a* is increased with increasing distance from edge guide 11*e*, or the diameter of opening holes 11*a* is reduced accordingly to effect the compensation. FIGS. 3 and 4 show examples of such arrangements and structures. In these embodiments, the total opening area per unit surface area $W=2500\ mm^2$, is gradually changed such that the total opening area in a unit surface area is set to about 92 $mm^2$ within a span of A3 size, then to about 56.5 $mm^2$ within a span of A2 size, and further to about 35 $mm^2$ within a span of A0 size.

According to experimental results obtained with the inventive printing apparatus having opening holes arranged as described above, the attractive force applied to a narrow recording medium 6 is reduced only by 20% as compared to a wider recording medium which can cover all of the opening holes 11*a* thereby efficiently ensuring the application of effective attraction forces to the narrower recording medium 6 against the face of platen 2 to avoid floating. Consequently, good printing can be carried out for recording media of various sizes without degradation of print quality.

As described above, according to the present invention, a recording medium can be closely contacted onto a flat section of platen within a region corresponding to the printing span of a head through attractive forces produced by vacuum means and opening holes having relatively small diameters to avoid floating, thereby achieving the effect that the distance between the nozzle tips of the head and the recording medium is controlled and maintained constant across the entire multinozzle arrangement.

Consequently, an ink jet recording apparatus can be provided such that reduction in targeting accuracy of ink droplets can be prevented to obtain high quality of print image with highly accurate dot positioning.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ink jet recording apparatus comprising:

a displacable print head of the on-demand type for ejecting ink droplets according to print data over a printing span;

a platen having a flat section facing said print head and extending at least over a region corresponding to said printing span through which said print head is displaced to effecting printing, said flat section of said platen having a plurality of opening holes; and vacuum means mounted to create a vacuum at the side of said platen which faces away from said print head, which vacuum acts through said holes to attract a recording medium onto said flat section to enable the recording medium to receive the ink droplets ejected from said head so as to print an image;

wherein said holes have a relatively small diameter and are arranged such that the total opening area of said holes per unit surface area of said platen is gradually changed in the direction in which said print head is displaced.

2. An ink jet recording apparatus according to claim 1 wherein the total opening area of said holes per unit surface area of said platen is gradually reduced in the direction in which said print head is displaced.

3. An ink jet recording apparatus according to claim 1 wherein the distance between adjacent holes is gradually changed in the direction in which said print head is displaced.

4. An ink jet recording apparatus according to claim 1 wherein the diameters of said holes are gradually changed in the direction in which said print head is displaced.

5. An ink jet recording apparatus according to claim 1 further comprising positioning means defining the position of an edge of the recording medium which is transverse to the printing span, and wherein the total opening area of said holes per unit surface areas of said platen is gradually reduced in the direction from said positioning means.

* * * * *